US007063648B1

(12) United States Patent
Brigham

(10) Patent No.: US 7,063,648 B1
(45) Date of Patent: Jun. 20, 2006

(54) EXERCISE MAT AND PUNCHING ASSEMBLY COMBINATION

(76) Inventor: Scott C. Brigham, 8333 Barton Farms Blvd., Sarasota, FL (US) 34240

( * ) Notice: Subject to any disclaimer, the term of this patent is extended or adjusted under 35 U.S.C. 154(b) by 536 days.

(21) Appl. No.: 10/633,442

(22) Filed: Aug. 4, 2003

(51) Int. Cl.
*A63B 69/34* (2006.01)
*A63B 69/22* (2006.01)

(52) U.S. Cl. ..... 482/83; 482/90; 482/23; 248/346.2; 248/346.5; 248/910

(58) Field of Classification Search ..... 482/23, 482/33, 35, 83–90; 473/441, 444, 445, 481; 248/519, 346.2, 346.5, 910; 472/93
See application file for complete search history.

(56) References Cited

U.S. PATENT DOCUMENTS

| | | | | |
|---|---|---|---|---|
| 2,197,545 | A | 4/1940 | Bachman | |
| 3,319,273 | A * | 5/1967 | Solin | 5/420 |
| 3,841,631 | A * | 10/1974 | Dolan | 473/481 |
| 4,486,016 | A * | 12/1984 | Rubin | 482/90 |
| 5,112,023 | A * | 5/1992 | Sowers | 248/519 |
| 5,220,740 | A * | 6/1993 | Brault | 40/606.02 |
| 5,232,368 | A | 8/1993 | Morgia | |
| 5,460,353 | A * | 10/1995 | Rittenhouse | 256/1 |
| 5,624,358 | A | 4/1997 | Hestilow | |
| 5,632,480 | A * | 5/1997 | Davis et al. | 473/483 |
| D409,670 | S | 5/1999 | Kuo | |
| 6,080,089 | A * | 6/2000 | Nicholson | 482/83 |
| 6,106,443 | A | 8/2000 | Kuo | |
| 6,183,399 | B1 * | 2/2001 | Chen | 482/90 |
| 6,251,051 | B1 | 6/2001 | Chen | |
| 6,390,958 | B1 * | 5/2002 | Chu | 482/90 |
| 6,464,621 | B1 * | 10/2002 | Chen | 482/83 |

OTHER PUBLICATIONS

Sportime 2000 Fall catalog, Referee Stand Pad, p. 256, Bison Qwik Court, p. 267.*

* cited by examiner

*Primary Examiner*—Jerome Donnelly
*Assistant Examiner*—Victor K. Hwang

(57) ABSTRACT

An exercise mat and punching assembly combination includes a base having a bottom wall, a top wall and a peripheral wall such that a substantially watertight interior of the base is defined. An inlet conduit extends into the interior. A peripheral lip is attached to and extends upwardly from the peripheral wall. A central member is selectively positionable on the top wall such that the central member is supported in vertical orientation by the peripheral lip. A panel comprised of a cushioning material has a size and shape such that the panel may be extended around the central member. A fastening assembly is attached to the panel for releasably fastening it around the central member. The interior of the base may be selectively filled with a liquid.

9 Claims, 5 Drawing Sheets

EXERCISE MAT AND PUNCHING ASSEMBLY COMBINATION

BACKGROUND OF THE INVENTION

1. Field of the Invention

The present invention relates to punching bag devices and more particularly pertains to a new punching bag device for that can be used as a punching bag while also providing an exercise mat.

2. Description of the Prior Art

The use of punching bag devices is known in the prior art. U.S. While these devices fulfill their respective, particular objectives and requirements, the need remains for a device that combines the usefulness of a punching bag with an exercise mat.

SUMMARY OF THE INVENTION

The present invention meets the needs presented above by incorporating a removable panel with a punching bag assembly so that the panel may be removed to be used an exercise mat. The mat may be used for stretching, sit-ups, push-ups and the like.

Another object of the present invention is to provide a new punching bag device that may be filled with water to alter the weight of the punching bag and to give the punching bag stability.

Still yet another object of the present invention is to provide a new punching bag device that includes a central member to which a plurality of punching targets may be removably attached.

To this end, the present invention generally comprises a base having a bottom wall, a top wall and a peripheral wall extending between and being attached to the bottom and top walls such that a substantially watertight interior of the base is defined. The peripheral wall has an inlet conduit extending into the interior. A peripheral lip is attached to and extends upwardly from a juncture of the peripheral wall and the top wall. A central member is selectively positionable on the top wall and extends upwardly therefrom. The peripheral lip extends around a lower portion of the central member such that the central member is supported in vertical orientation. A panel has a first end edge, a second end edge, an upper edge and a lower edge. The panel comprises a cushioning material and has a size and shape such that the panel may be extended around the central member such that the first and second end edges are positioned adjacent to each other. A fastening assembly is attached to the panel for releasably fastening the first end edge to the second end edge. The interior of the base may be selectively filled with a liquid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
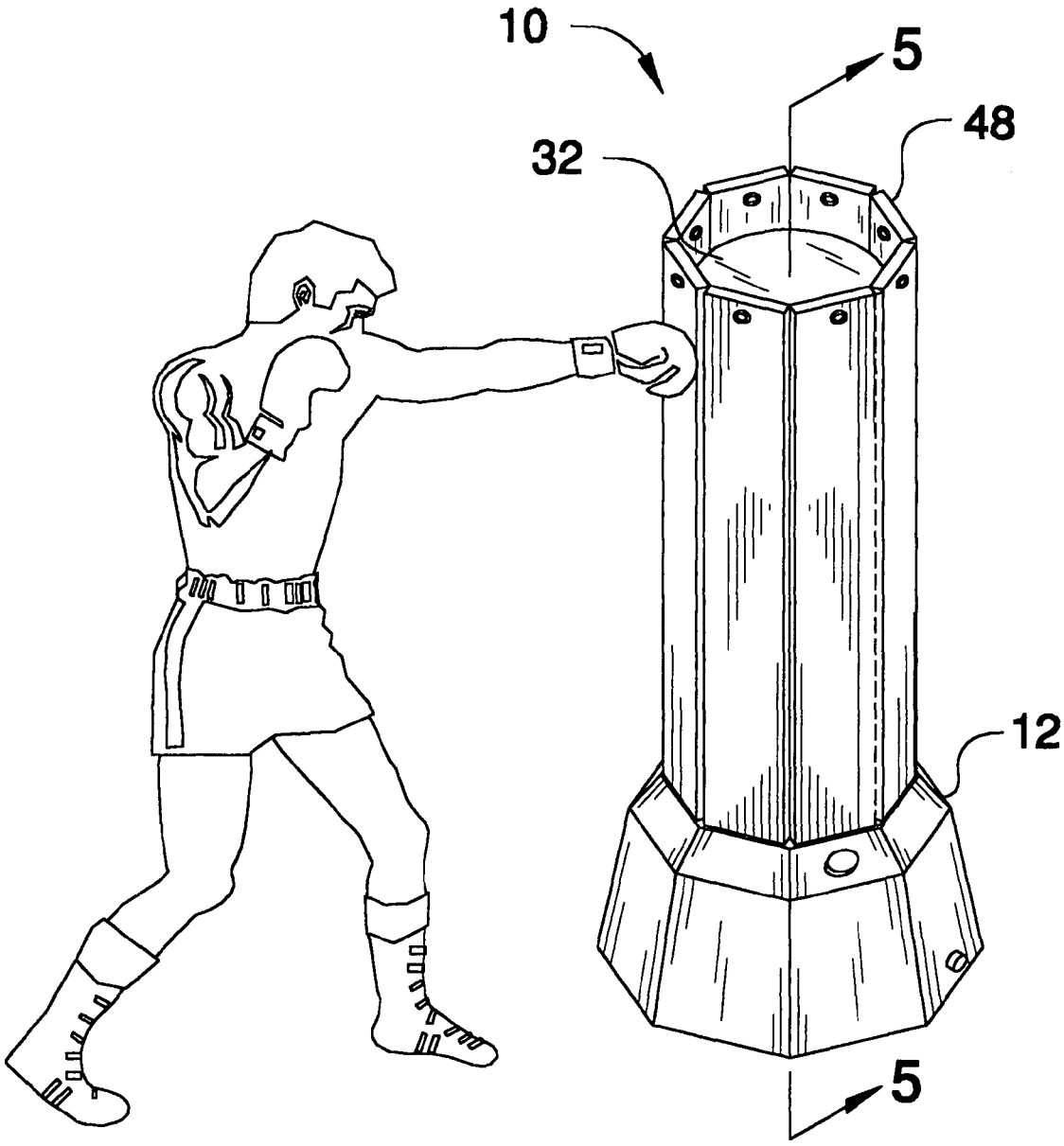
FIG. 1 is a schematic perspective in-use view of an exercise mat and punching assembly combination according to the present invention.
Figure 2:
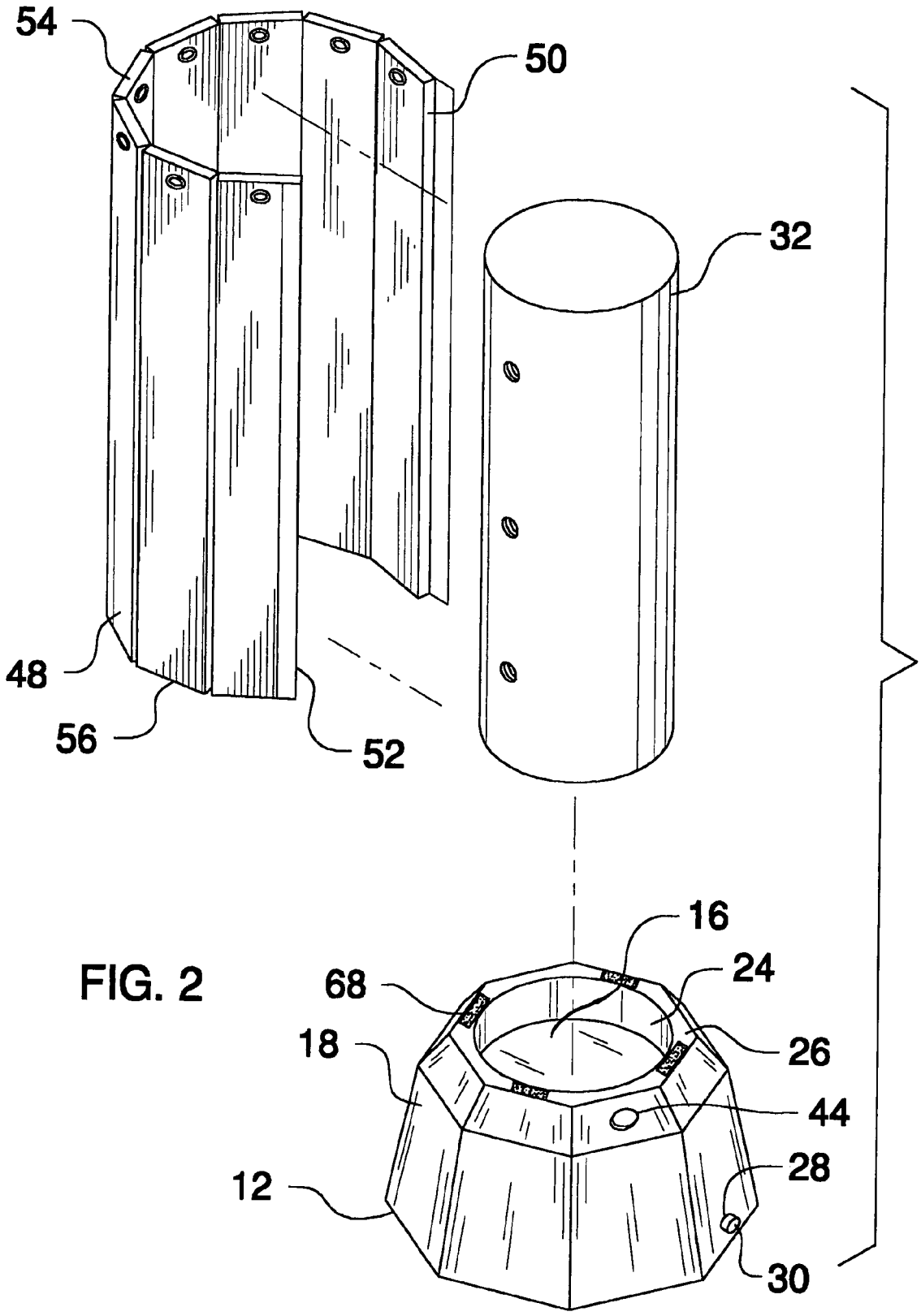
FIG. 2 is a schematic expanded perspective view of the present invention.

With reference now to the drawings, and in particular to FIGS. 1 through 7 thereof, a new punching bag device embodying the principles and concepts of the present invention and generally designated by the reference numeral 10 will be described.

As best illustrated in FIGS. 1 through 7, the exercise mat and punching assembly combination 10 generally comprises a base 12 having a bottom wall 14, a top wall 16 and a peripheral wall 18 extending between and is attached to the bottom 14 and top 16 walls such that a substantially watertight interior 20 of the base 12 is defined. The peripheral wall 18 has an inlet conduit 22 extending through the top wall 16 and into the interior 20. Preferably, a cap 23 may be selectively fitted over the inlet conduit 22 for selectively opening or closing such. A peripheral lip 24 is attached to and extends upwardly from a juncture of the peripheral wall 18 and the top wall 16. A drainage hole 28 extends through the peripheral wall 18. A plug member 30 is positioned in the drainage hole 28 for selectively opening or closing the drainage hole 28. The peripheral wall 18 is angled inward from the bottom wall 14 to the top wall 16. The peripheral lip 24 has an inner diameter having a generally circular shape.

Figure 5:
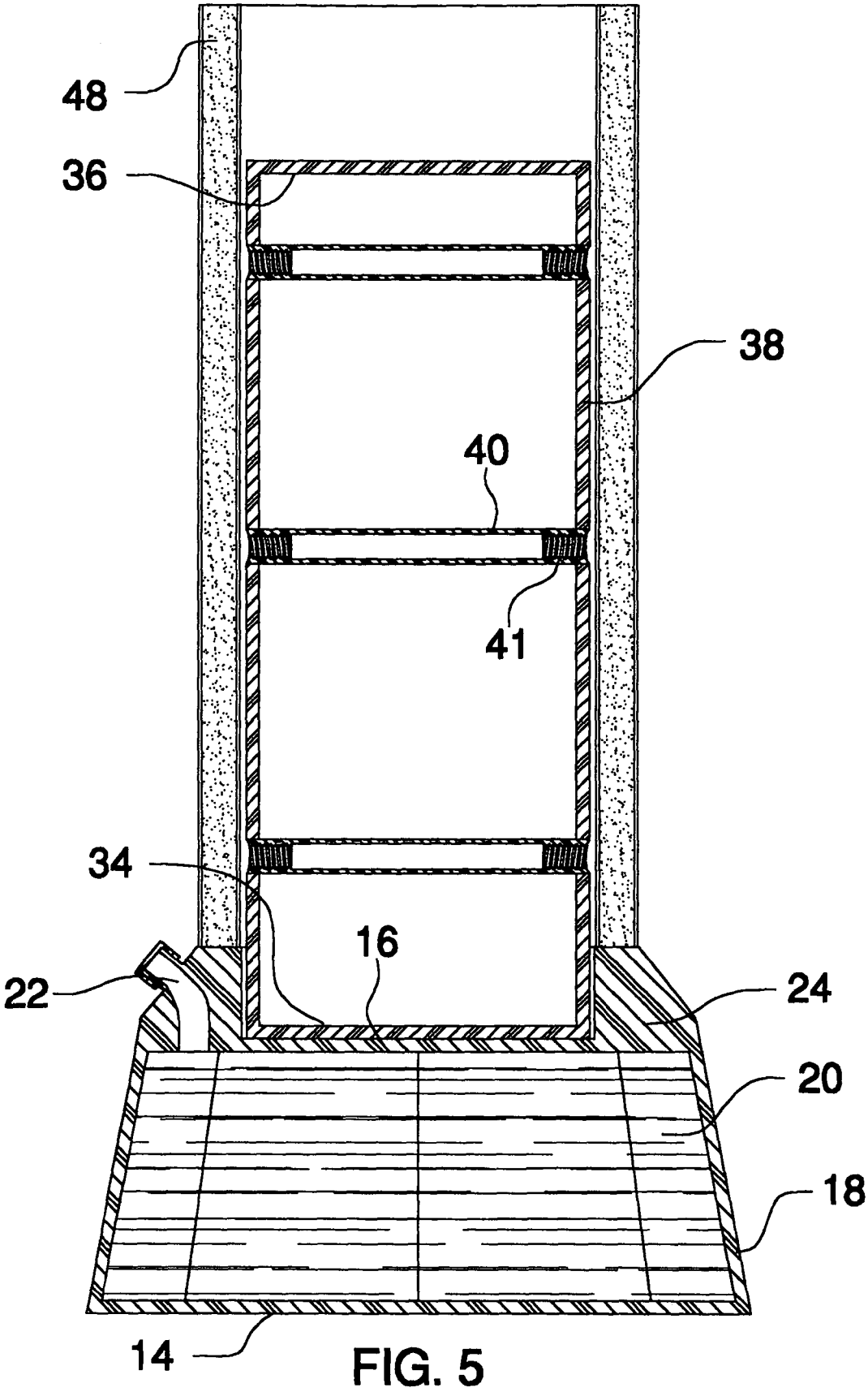
FIG. 5 is a schematic cross-sectional view taken along line 5—5 of FIG. 1 of the present invention.
Figure 6:
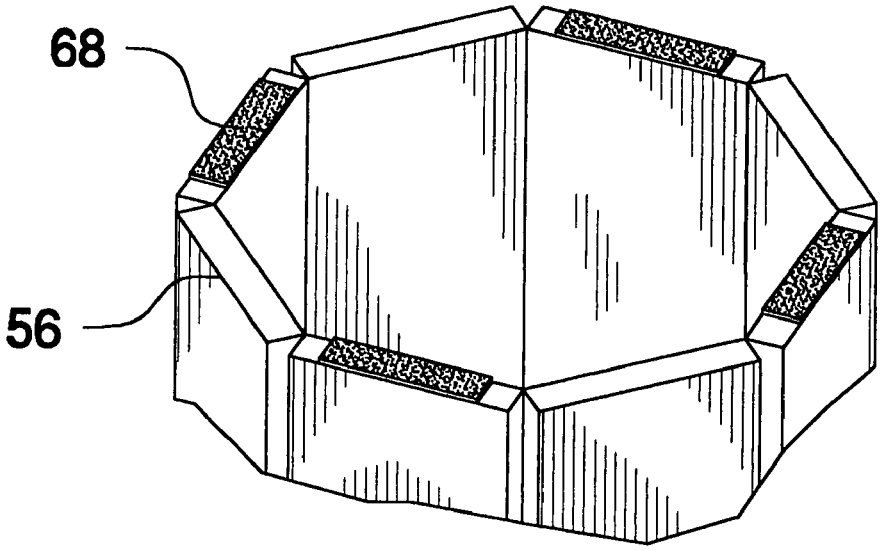
FIG. 6 is a schematic perspective view of the bottom edge of the panel of the present invention.
Figure 7:
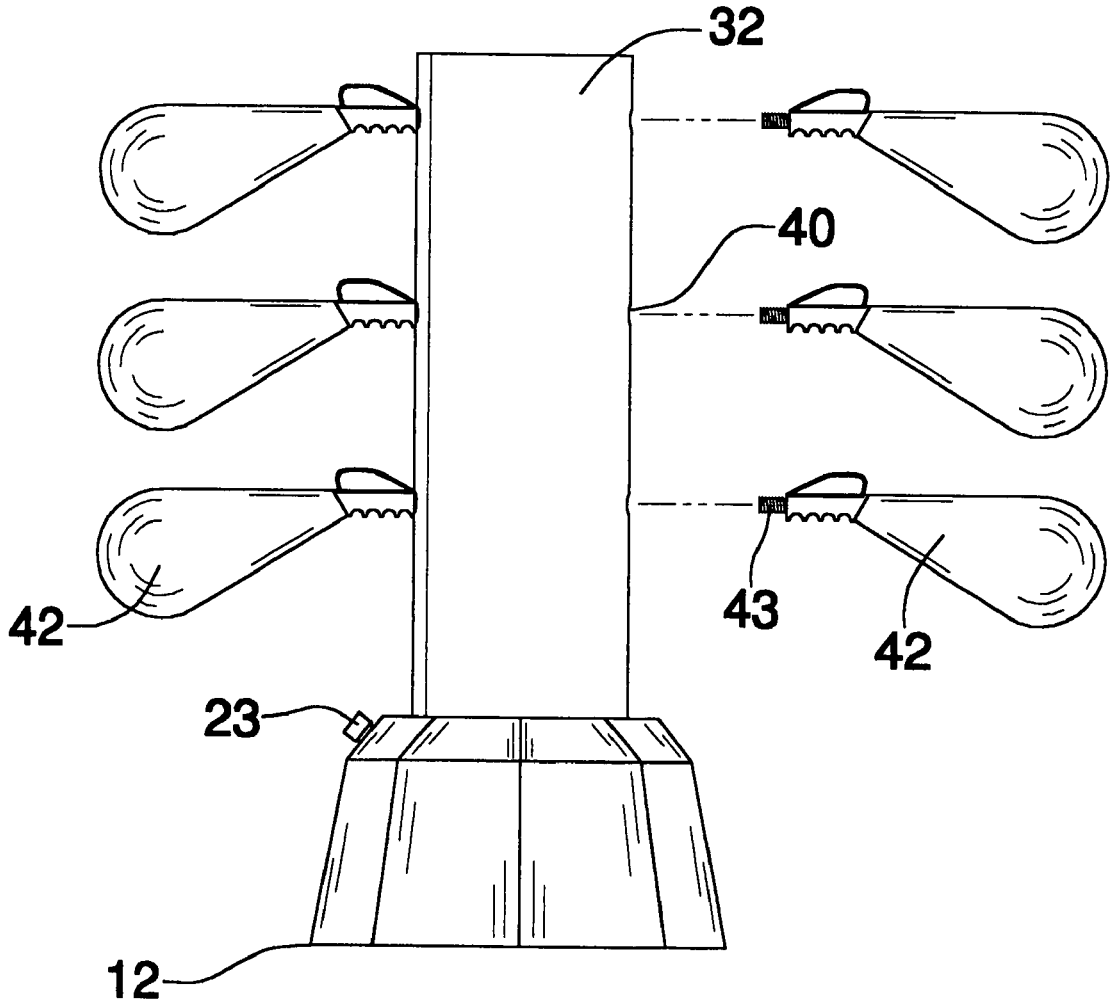
FIG. 7 is a side view of the hitting targets of the present invention.

A central member 32 is selectively positionable on the top wall 16 and extends upwardly therefrom. The peripheral lip 24 extends around a lower portion of the central member 32 such that the central member 32 is supported in vertical orientation. The central member 32 includes a lower wall 34, an upper wall 36 and a perimeter wall 38 extending between and is attached to the lower wall 34 and the upper wall 36. The perimeter wall 38 has a plurality of wells 40 extending therein. Each of the wells 40 has a threaded surface 41. The wells 40 may be formed by tubes extending through the central member 32 as depicted in FIG. 5. The wells are preferably distributed at varying distances from the upper wall 36. The central member 32 preferably has a substantially cylindrical shape. A plurality of punching targets 42 each includes a rod 43 attached thereto. The punching targets 42 are preferably cushioned bags having a volume of less than 2 cubic feet. Each of the rods 43 is selectively extendable into one of the wells 40. The rods 43 are each threaded for threadably coupling with the threaded surfaces 41 of the walls.

A panel 48 has a first end edge 50, a second end edge 52, an upper edge 54 and a lower edge 56. The panel 48 comprises a cushioning material and defines and exercise mat preferably having a plurality of sections 58 pivotally coupled together. The panel 48 has a size and shape such that the panel 48 may be extended around the central member 32 such that the first 50 and second 52 end edges are positioned adjacent to each other. The panel 48 may include a plurality of apertures 59 extending therethrough and positioned generally adjacent to the upper edge 54 for selectively hanging the panel 48.

A fastening assembly 60 is attached to the panel 48 for releasably fastening the first end edge 50 to the second end edge 52. The fastening assembly includes a flap 62 that is attached to and extends away from a length of the first side edge 50. A first mating portion 64 is attached to the flap 62. A second mating portion 66 is attached to the panel 48 and is positioned adjacent to the second side edge 52. The first mating portion 64 may be selectively attached to the second mating portion 66. The first 64 and second 66 mating portions preferably comprise a hook and loop fastening assembly, though snaps, a zipper or other mechanical fasteners may be used.

A securing assembly 68 is attached to the panel 48 and the peripheral lip 24 for releasably securing the panel 48 to an upper edge 26 of the peripheral lip 24. The securing assembly 68 preferably also includes a hook and loop fastening assembly having a hook portion and a loop portion. One of the hook and loop portions is attached to an upper edge 26 of the peripheral lip 24 and the other of the hook and loop portions is attached to the lower edge 56 of the panel 48.

Figure 3:
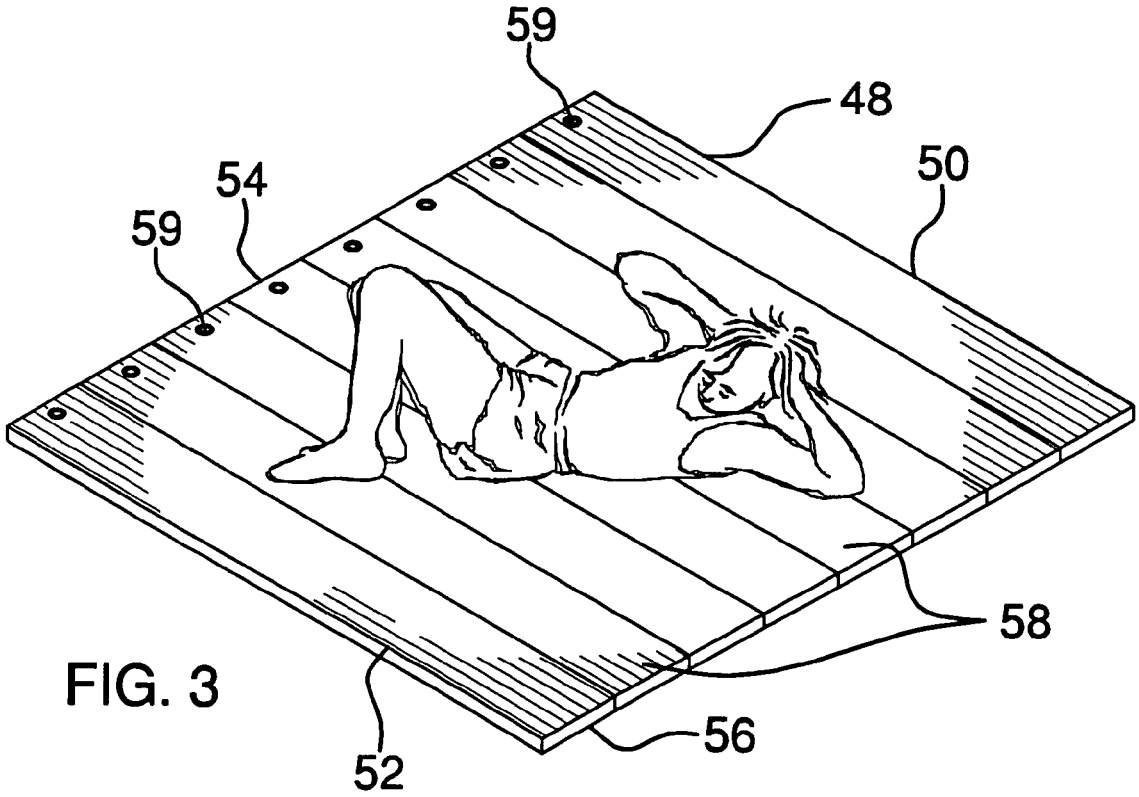
FIG. 3 is a schematic perspective view of the panel of the present invention.
Figure 4:
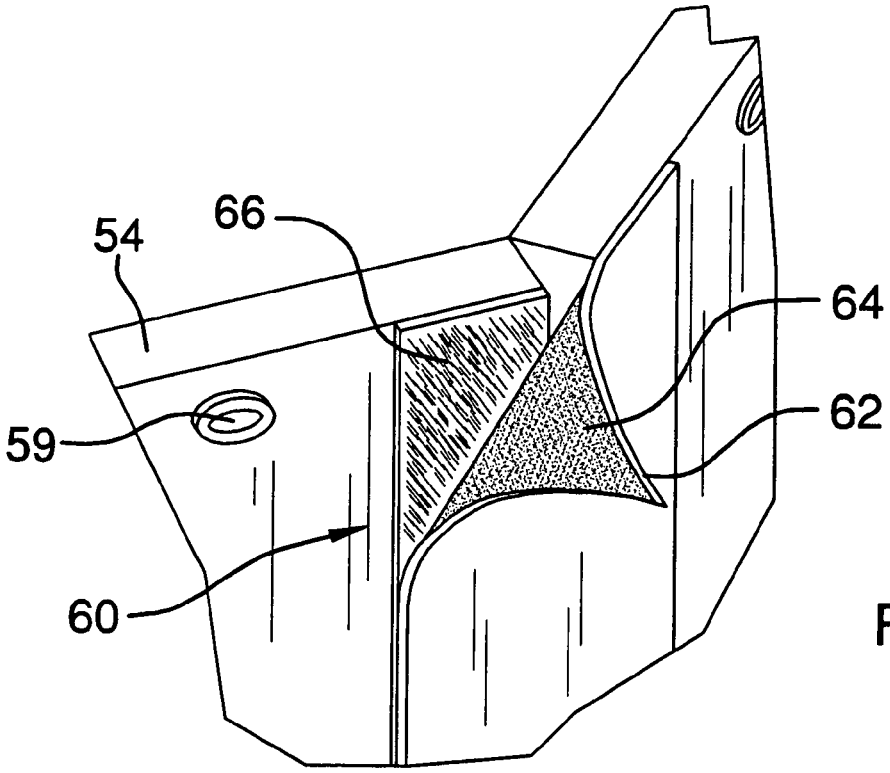
FIG. 4 is a schematic perspective view of the panel of the present invention.

In use, the interior 20 of the base 12 may be selectively filled with a liquid, preferably water. The water gives the base 12 stability and weight so that they it is not easily moved and can withstand kicks or punches without excessive shifting or movement. The panel 48 is positioned around the central member 32 when the central member 32 is used as a punching or kicking bag. The user may remove the panel 48 from the central member 32 and use it as a conventional exercise mat as shown in FIG. 3. With the panel 48 removed, the hitting targets 42 may be attached to the central member to offer varyingly positioned targets for hitting and kicking.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A punching bag and exercise mat combination device comprising:

a base having a bottom wall, a top wall and a peripheral wall extending between and being attached to said bottom and top walls such that a substantially watertight interior of said base is defined, said base having an inlet conduit extending into said interior, a peripheral lip being attached to and extending upwardly from a juncture of said peripheral wall and said top wall;

a central member being selectively positionable on said top wall and extending upwardly therefrom, said peripheral lip extending around a lower portion of said central member such that said central member is supported in vertical orientation;

a panel having a first end edge, a second end edge, an upper edge and a lower edge, said panel comprising a cushioning material, said panel having a size and shape such that said panel may be extended around said central member such that said first and second end edges are positioned adjacent to each other;

a fastening assembly being attached to said panel for releasably fastening said first end edge to said second end edge;

a securing assembly being attached to said panel and said peripheral lip for releasably securing said panel to an upper edge of said peripheral lip; and wherein said interior of said base may be selectively filled with a liquid.

2. The device of claim 1, further including said base having a drainage hole extending through said peripheral wall, a plug member being positioned in said drainage hole for selectively opening or closing said drainage hole.

3. The device of claim 1, said peripheral wall being angled inward from said bottom wall to said top wall.

4. The device of claim 1, wherein said central member includes a lower wall, an upper wall and a perimeter wall extending between and being attached to said lower wall and said upper wall, said perimeter wall having a plurality of wells extending therein, a plurality of punching targets each including a rod attached thereto, each of said rods being selectively extendable into one of said wells.

5. The device of claim 4, wherein each of said wells has a threaded surface, each of said rods being threaded for threadably coupling with said threaded surfaces of said walls.

6. The device of claim 4, further including a securing assembly being attached to said panel and said peripheral lip for releasably securing said panel to an upper edge of said peripheral lip.

7. The device of claim 1, wherein said fastening assembly including a flap being attached to and extending away from a length of said first side edge, a first mating portion being attached to said flap, a second mating portion being attached to said panel and being positioned adjacent to said second side edge, wherein said first mating portion may be selectively attached to said second mating portion, said first and second mating portions comprising a hook and loop fastening assembly.

8. A punching bag and exercise mat combination device comprising:

a base having a bottom wall, a top wall and a peripheral wall extending between and being attached to said bottom and top walls such that a substantially watertight interior of said base is defined, said peripheral wall having an inlet conduit extending through said top wall and into said interior, a peripheral lip being attached to and extending upwardly from a juncture of said peripheral wall and said top wall, a drainage hole extending through said peripheral wall, a plug member being positioned in said drainage hole for selectively opening or closing said drainage hole, said peripheral wall being angled inward from said bottom wall to said top wall, said peripheral lip having an inner diameter having a generally circular shape;

a central member being selectively positionable on said top wall and extending upwardly therefrom, said peripheral lip extending around a lower portion of said central member such that said central member is supported in vertical orientation, said central member including a lower wall, an upper wall and a perimeter wall extending between and being attached to said lower wall and said upper wall, said perimeter wall having a plurality of wells extending therein, each of said wells having a threaded surface, said central member having a substantially cylindrical shape;

a plurality of punching targets each including a rod attached thereto, each of said rods being selectively extendable into one of said wells, each of said rods being threaded for threadably coupling with said threaded surfaces of said walls;

a panel having a first end edge, a second end edge, an upper edge and a lower edge, said panel comprising a cushioning material, said panel having a size and shape such that said panel may be extended around said central member such that said first and second end edges are positioned adjacent to each other;

a fastening assembly being attached to said panel for releasably fastening said first end edge to said second end edge, said fastening assembly including a flap being attached to and extending away from a length of said first side edge, a first mating portion being attached to said flap, a second mating portion being attached to said panel and being positioned adjacent to said second side edge, wherein said first mating portion may be selectively attached to said second mating portion, said first and second mating portions comprising a hook and loop fastening assembly;

a securing assembly being attached to said panel and said peripheral lip for releasably securing said panel to an upper edge of said peripheral lip; and wherein said interior of said base may be selectively filled with a liquid.

9. A punching bag and exercise mat combination device comprising:

a base having a bottom wall, a top wall and a peripheral wall extending between and being attached to said bottom and top walls such that a substantially watertight interior of said base is defined, said base having an inlet conduit extending into said interior, a peripheral lip being attached to and extending upwardly from a juncture of said peripheral wall and said top wall;

a central member being selectively positionable on said top wall and extending upwardly therefrom, said peripheral lip extending around a lower portion of said central member such that said central member is supported in vertical orientation, said central member includes a lower wall, an upper wall and a perimeter wall extending between and being attached to said lower wall and said upper wall, said perimeter wall having a plurality of wells extending therein;

a plurality of punching targets each including a rod attached thereto, each of said rods being selectively extendable into one of said wells;

a panel having a first end edge, a second end edge, an upper edge and a lower edge, said panel comprising a cushioning material, said panel having a size and shape such that said panel may be extended around said central member such that said first and second end edges are positioned adjacent to each other;

a fastening assembly being attached to said panel for releasably fastening said first end edge to said second end edge; and wherein said interior of said base may be selectively filled with a liquid.

* * * * *